US009845557B2

(12) United States Patent
Ninomiya et al.

(10) Patent No.: US 9,845,557 B2
(45) Date of Patent: Dec. 19, 2017

(54) SEWING MACHINE

(71) Applicant: Janome Sewing Machine Co., Ltd., Tokyo (JP)

(72) Inventors: Masashi Ninomiya, Tokyo (JP); Yoshikazu Ebata, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 497 days.

(21) Appl. No.: 14/584,990

(22) Filed: Dec. 29, 2014

(65) Prior Publication Data

US 2016/0040339 A1 Feb. 11, 2016

(30) Foreign Application Priority Data

Aug. 5, 2014 (JP) ..... 2014-159790

(51) Int. Cl.
*D05B 57/00* (2006.01)
*D05B 1/06* (2006.01)
*D05B 57/02* (2006.01)

(52) U.S. Cl.
CPC ..... *D05B 1/06* (2013.01); *D05B 57/02* (2013.01)

(58) Field of Classification Search
CPC ..... D05B 57/00; D05B 57/02; D05B 57/04; D05B 57/14; D05B 57/143; D05B 57/20; D05B 57/26; D05B 57/265
See application file for complete search history.

(56) References Cited

U.S. PATENT DOCUMENTS 3,540,390 A * 11/1970 Eguchi ..... D05B 1/06 112/168
3,807,330 A * 4/1974 Ono ..... D05B 57/12 112/168
4,278,037 A * 7/1981 Creed ..... D05B 1/14 112/168
4,487,142 A 12/1984 Rodda et al.
5,165,354 A * 11/1992 Wahlstrand ..... D05B 57/16 112/228
6,076,477 A * 6/2000 Badillo ..... D05B 57/26 112/231
7,171,914 B2 * 2/2007 Ota ..... D05B 57/20 112/231

FOREIGN PATENT DOCUMENTS

JP S45-33108 B2 10/1970
JP S49-18739 B2 5/1974
JP S56-20032 B2 5/1981
JP S56-47787 B2 11/1981
JP H03-66911 B2 10/1991

* cited by examiner

*Primary Examiner* — Nathan Durham
(74) *Attorney, Agent, or Firm* — Nakanishi IP Associates, LLC

(57) ABSTRACT

A sewing machine includes a horizontal hook that is held within an outer hook and an accommodating portion of the outer hook that includes a spiral-shaped columnar portion to which the thread loop captured by the hook point is wound. The sewing machine also includes a chain looper that guide the thread loop induced in spiral shape upward, and an inner hook for chain stitching that is supported by the outer hook that restricting upward movement of the thread loop drawn into the interior of the outer hook.

7 Claims, 21 Drawing Sheets

X-X

Y–Y

SEWING MACHINE

CROSS REFERENCE TO RELATED APPLICATIONS

This application is based on and claims the benefit of priority to Japanese Patent Application No. 2014-159790 filed on Aug. 5, 2014, the contents of which are hereby incorporated by reference in their entirety.

FIELD OF THE INVENTION

The present invention relates to a sewing machine capable of performing chain stitching.

DESCRIPTION OF THE RELATED ART

Sewing machines capable of performing chain stitching are conventionally known. The applicants of the present invention have suggested sewing machines which perform chain stitching using only needle threads in sewing machines which perform lock stitching using needle threads and bobbin threads (see Patent Literature 1, Patent Literature 2 and Patent Literature 3). Such chain stitching differs from cases of lock switching in that one surface is configured similarly to lock switching using a single thread while the other surface on the opposite side is sewn in a shape of a chain. Since such sewing machines capable of performing chain stitching can correspond to use such as basting and seal stitches, they have been suggested as sewing machines which enlarges the available range of sewing machines.

However, all of sewing machines according to the above-mentioned suggestions are sewing machines comprising perpendicular hooks, and the inventions could not be applied to sewing machines comprising horizontal hooks.

Sewing machines capable of performing chain stitching using only needle threads in sewing machines comprising horizontal hooks are disclosed in Patent Literature 4 and Patent Literature 5.

PRIOR ART LITERATURE

Patent Literature

[Patent Literature 1] Japanese Patent Publication No. S45-33108

[Patent Literature 2] Japanese Patent Publication No. S49-18739

[Patent Literature 3] Japanese Patent Publication No. S56-20032

[Patent Literature 4] Japanese Patent Publication No. S56-47787

[Patent Literature 5] Japanese Patent Publication No. H03-66911

SUMMARY OF THE INVENTION

However, according to the techniques of Patent Literature 4 and Patent Literature 5, special structures were required on throat plate sides since thread holding of a single thread was difficult due to their structures, and since preparing operations where complicated since exclusive thread holders and throat plates were required and other factors, the sewing machines could not be used easily.

One or more embodiments of the present invention provide a sewing machine with a simple configuration in which chain stitching can be easily performed even when the sewing machine comprises a horizontal hook.

Embodiment (1): One or more embodiments of the present invention provide a sewing machine comprising a horizontal hook that rotates twice around a vertical center of rotation with respect to a reciprocating direction of a needle when the needle performs a single reciprocating movement in the up and down direction, wherein the horizontal hook comprises an outer hook including a hook point that captures a thread loop of a needle thread and an accommodating portion that is formed to open upwardly, a chain looper that is held within the accommodating portion of the outer hook to be attachable/detachable to and from the outer hook and to move integrally with the outer hook, that includes a spiral-shaped columnar portion to which the thread loop captured by the hook point is wound, and that rotates together with the pulling the thread up and the rotation of the outer hook to guide the thread loop induced in spiral shape upward, and an inner hook for chain stitching that is supported by the outer hook, that forms a thread space upward of the chain looper and that restricts upward movement of the thread loop drawn into the interior of the outer hook.

Embodiment (2): One or more embodiments of the present invention provide the sewing machine of Embodiment (1), wherein the chain looper is held in the accommodating portion of the outer hook at a position concentric with the center of rotation of the outer hook.

Embodiment (3): One or more embodiments of the present invention provide the sewing machine of Embodiment (1), wherein the inner hook for chain stitching further guides a thread loop drawn into the interior of the outer hook out of the thread loop that has been captured by the hook point to the chain looper.

Embodiment (4): One or more embodiments of the present invention provide the sewing machine of Embodiment (1), wherein the accommodating portion of the outer hook is formed such that an inner hook for lock stitching can be mounted instead of the chain looper and the inner hook for chain stitching.

Embodiment (5): One or more embodiments of the present invention provide the sewing machine of Embodiment (1), wherein a thread loop guiding portion for guiding a thread loop is formed on a lower surface of the inner hook for chain stitching.

Embodiment (6): One or more embodiments of the present invention provide the sewing machine of Embodiment (5), wherein the thread loop guiding portion is formed to become narrower towards a downward tip thereof.

Embodiment (7): One or more embodiments of the present invention provide the sewing machine of Embodiment (5), wherein the tip of the thread loop guiding portion is disposed proximate of a base of the spiral-shaped columnar portion at which the spiral-shaped columnar portion receives the thread loop.

According to one or more embodiments of the present invention, it is possible to realize a sewing machine with a simple configuration in which chain stitching can be easily performed even when the sewing machine comprises a horizontal hook.

DETAILED DESCRIPTION OF THE PREFERRED EMBODIMENTS

Figure 1:
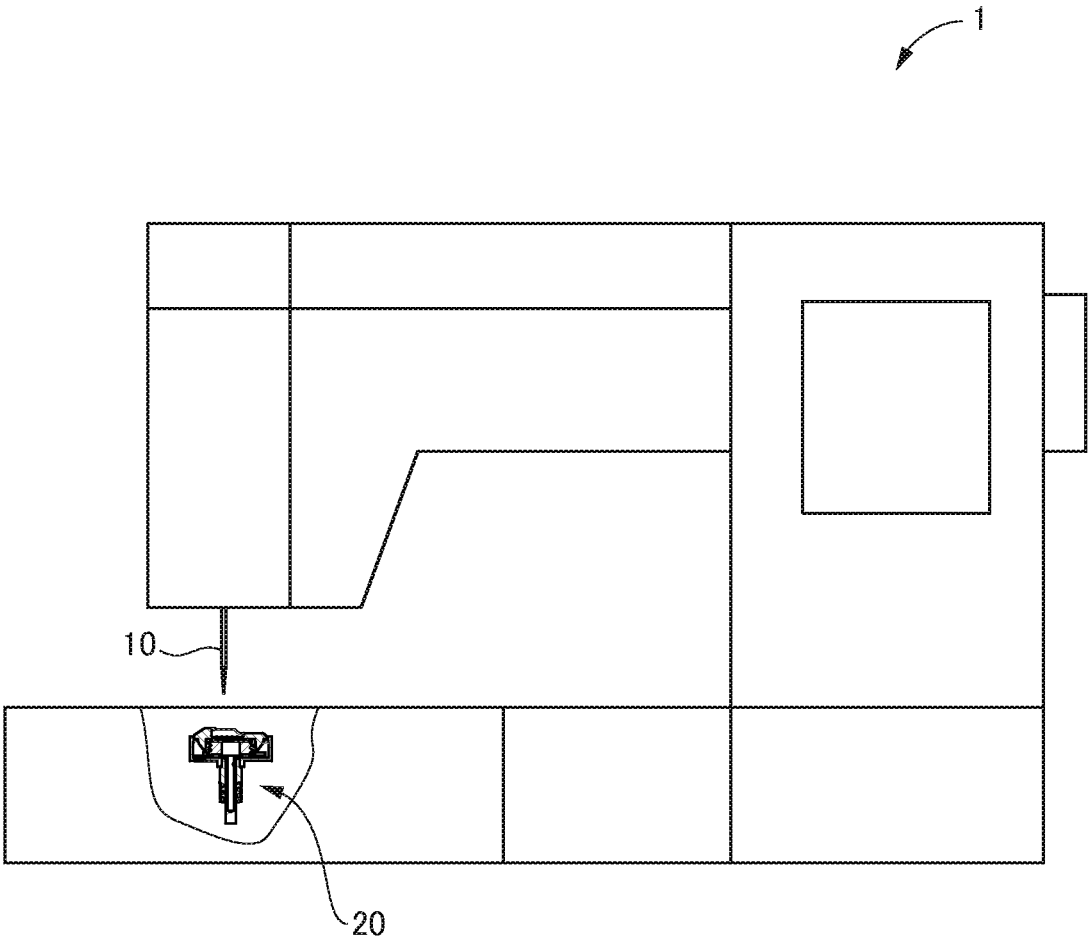
FIG. 1 A view showing an embodiment of the sewing machine according to the present invention.

A best mode for embodying the present invention will now be explained while referring to the drawings and others.

<Embodiment>

FIG. 1 is a view showing an embodiment of the sewing machine according to the present invention.

In this respect, each of the drawings including FIG. 1 indicated hereinafter are schematically illustrated drawings, and sizes and shapes of respective portions are shown in suitably exaggerated form for ease of understanding.

Further, while explanations are made upon indicating specific numerical values, shapes and materials in the following explanations, they may be suitably changed.

The sewing machine 1 according to the present embodiment comprises a needle 10 and a horizontal hook 20.

The needle 10 performs reciprocating movements in the up and down direction (vertical direction) when performing sewing when the sewing machine 1 is correctly set up on a horizontal set up surface.

The horizontal hook 20 is at a position that the needle 10 reaches when it has moved downward in its movable range, and it is set up in an interior of the sewing machine 1 such that it rotates twice around a vertical center of rotation with respect to the reciprocating direction of the needle 10 when the needle 10 performs a single reciprocating movement in the up and down direction.

Figure 2:
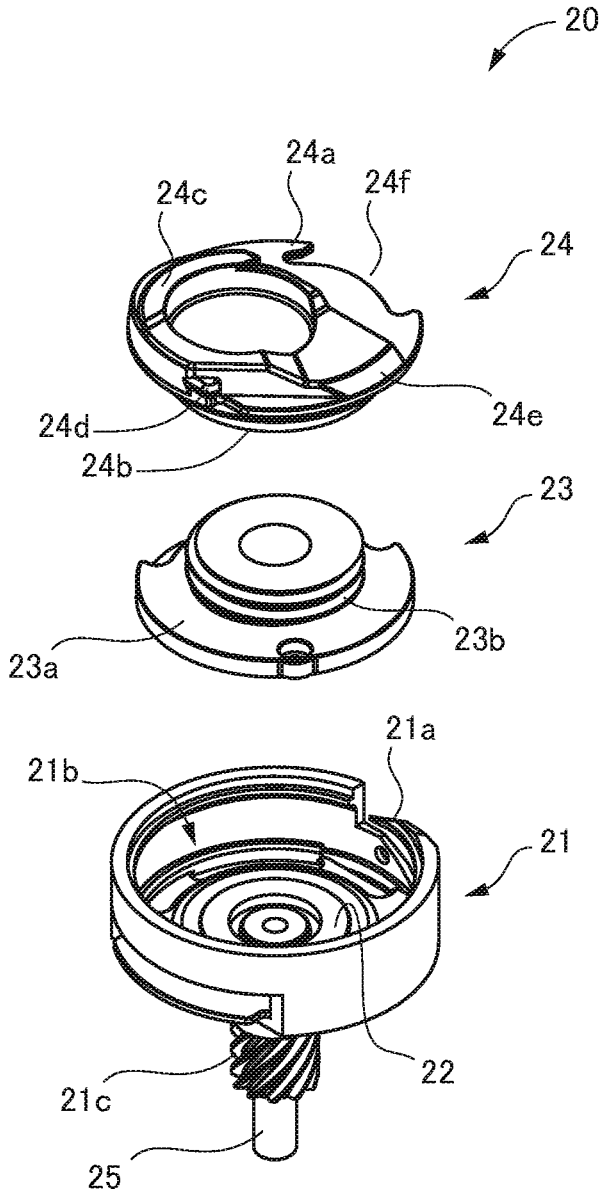
FIG. 2 An exploded perspective view of a horizontal hook 20.

FIG. 2 is an exploded perspective view of a horizontal hook 20.

Figure 3:
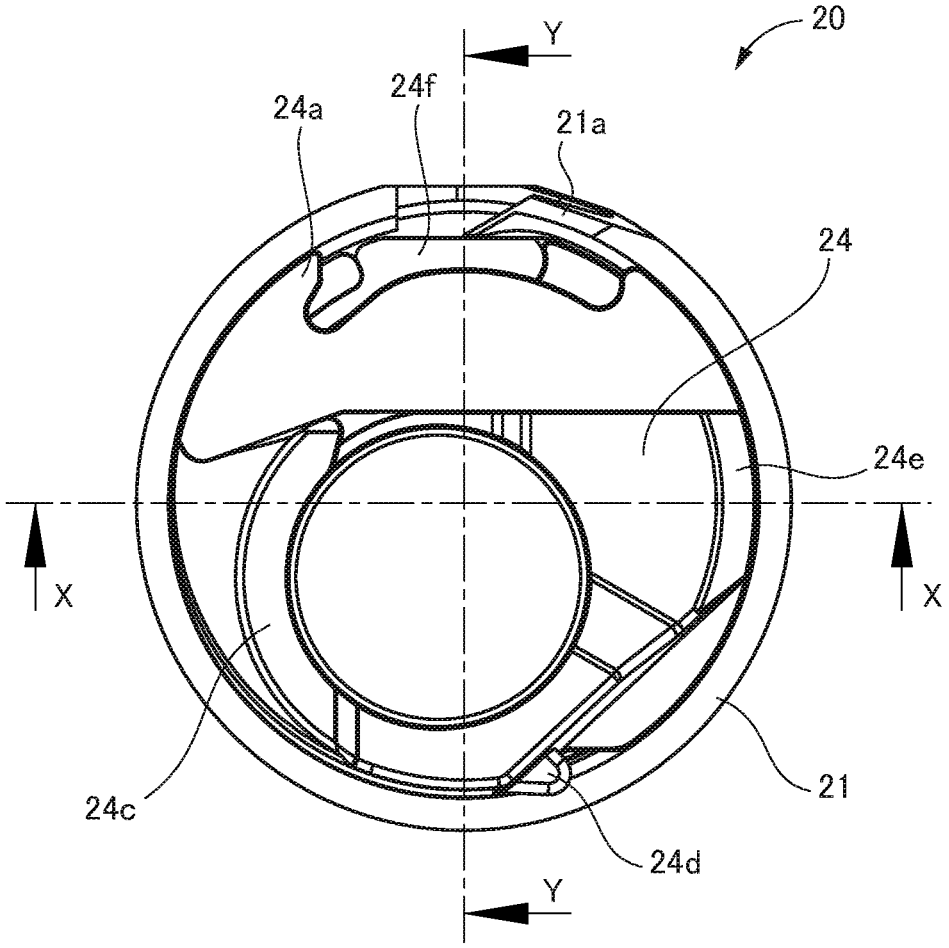
FIG. 3 A view in which the horizontal hook 20 is seen from above.

FIG. 3 is a view in which the horizontal hook 20 is seen from above.

Figure 4:
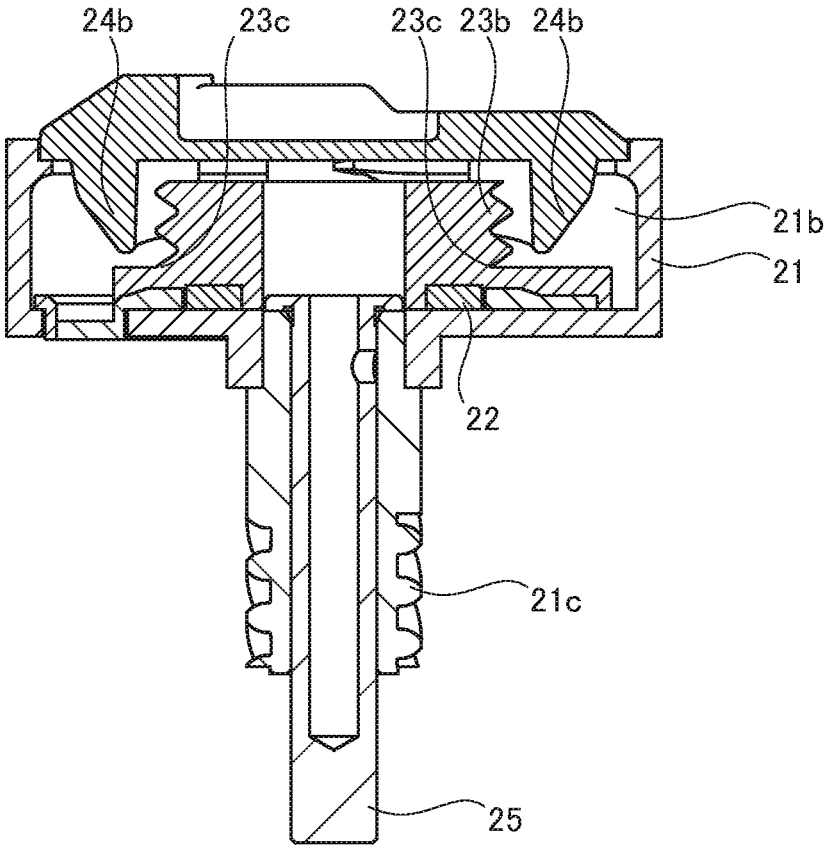
FIG. 4 A sectional view at a position of arrow X-X shown in FIG. 3.

FIG. 4 is a sectional view at a position of arrow X-X shown in FIG. 3.

Figure 5:
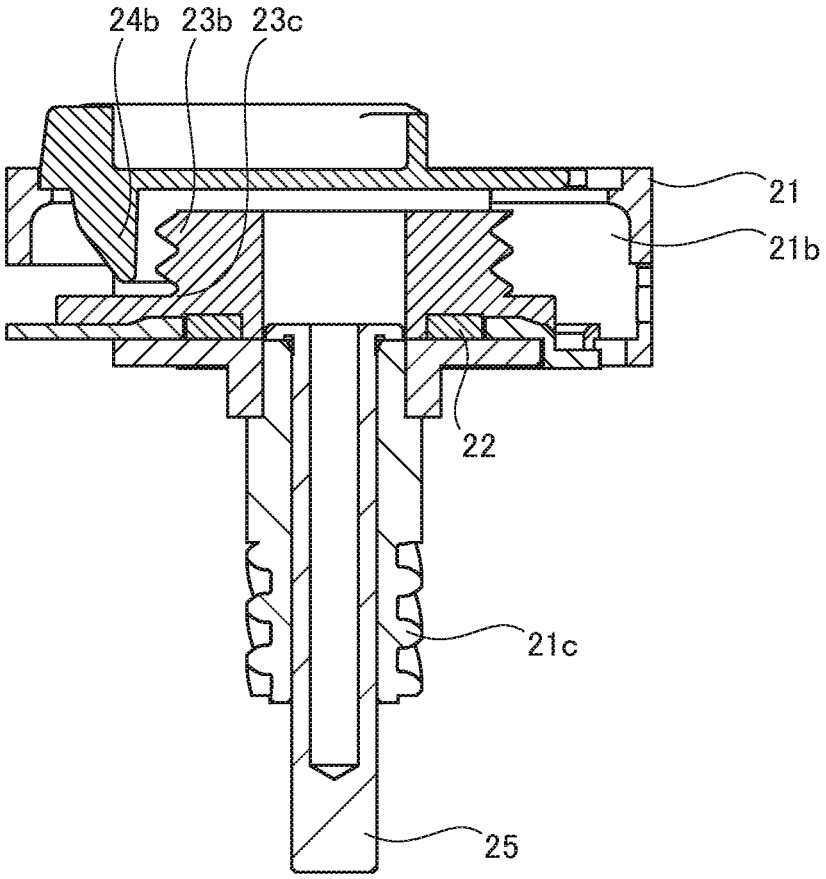
FIG. 5 A sectional view at a position of arrow Y-Y shown in FIG. 3.

FIG. 5 is a sectional view at a position of arrow Y-Y shown in FIG. 3.

The horizontal hook 20 includes an outer hook 21, a magnet 22, a chain looper 23 and an inner hook for chain stitching 24.

The outer hook 21 comprises a hook point 21*a*, an accommodating portion 21*b* and a gear portion 21*c*. In this respect, while the outer hook 21 according to the present embodiment is configured of a plurality of parts for ease of manufacture, these parts might suitably be integrated.

Figure 8A:
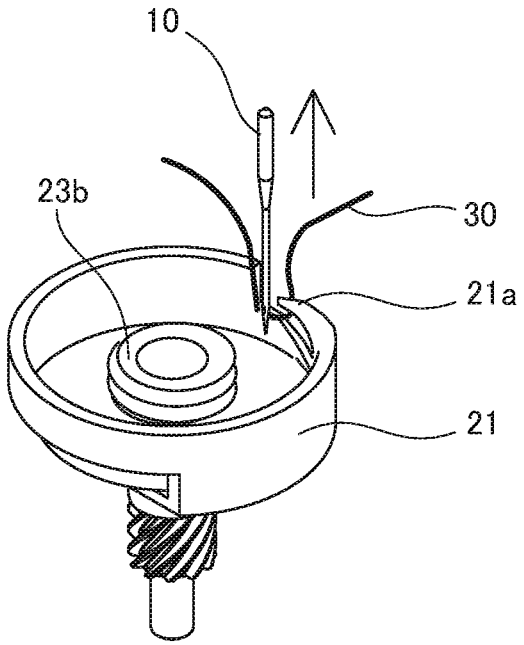
FIG. 8A A view showing a process of performing chain stitching.

The hook point 21*a* is provided along an outer peripheral surface of the outer hook 21 and I formed into a shape having a pointed tip for capturing a needle thread loop (thread loop) of the needle thread 30 that passes through the needle 10 (see FIG. 8A and others).

The accommodating portion 21*b* is formed to open upwardly to accommodate the chain looper 23 and the inner hook for chain stitching 24.

The gear portion 21*c* is mounted integrally with the outer hook 21 to rotate around a shaft 25 as a center of rotation that projects in a substantially columnar shape downward of the accommodating portion 21*b*. The gear portion 21*c* is in mesh with a driving gear that is provided at a driving shaft (not shown). The outer hook 21 rotates in sync with up and down movements of the needle 10 when the gear portion 21*c* receives driving force from the driving gear.

The magnet 22 is fixed to a lower bottom portion within the accommodating portion 21*b* by using an adhesive or the like.

The chain looper 23 includes a disk portion 23*a* and a spiral-shaped columnar portion 23*b*, and is held within the accommodating portion 21*b* of the outer hook 21 and at a position concentric with the center of rotation of the outer hook 21 to be attachable/detachable to and from the outer hook 21 and to move integrally with the outer hook 21.

The disk portion 23*a* is formed at a lower end side of the chain looper 23 to expand in a substantially disk-like shape. The disk portion 23*a* mates with a shape of the lower bottom portion of the accommodating portion 21*b* to integrally attach the chain looper 23 with respect to the outer hook 21.

The spiral-shaped columnar portion 23*b* projects upwardly from the disk portion 23*a* in a substantially columnar shape, and a spiral shape is formed on an outer peripheral surface thereof. A needle thread loop (thread loop) captured by the hook point 21*a* is wound to the spiral-shaped columnar portion 23*b*. The chain looper 23 rotates together with pulling the thread up and the rotation of the outer hook 21, and the needle thread loop induced by the spiral shape of the spiral-shaped columnar portion 23*b* is guided upward together with the rotation of the outer hook 21.

The inner hook for chain stitching 24 is located further upward of the chain looper 23, and is supported by a wall-like portion that forms an outer periphery of the outer hook 21.

The inner hook for chain stitching 24 is formed to have a substantially disk-like shape to substantially cover an aperture of the accommodating portion 21*b*, and includes a first thread guiding portion 24*a*, a first cam surface 24*b*, a second thread guiding portion 24*c*, a protruding portion 24*d*, a second cam surface 24*e* and a thread space 24*f*.

The first thread guiding portion 24*a* has a small protruding shape in form of a hook projecting towards the thread space 24*f* side. The first thread guiding portion 24*a* assists reliable guidance of a thread located inside of the outer hook 21 out of the needle thread loop captured by the hook point 21*a* to downside of the hook point 21*a*.

Figure 6:
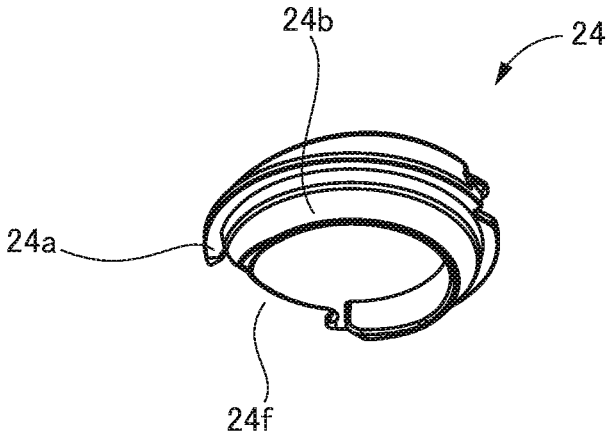
FIG. 6 A perspective view in which an inner hook for chain stitching 24 is seen from below.

FIG. 6 is a perspective view in which the inner hook for chain stitching 24 is seen from below.

The first cam surface 24*b* projects downward from the inner hook for chain stitching 24 and has an annular shape of which a portion corresponding to the thread space 24*f* is cut off. The first cam surface 24*b* functions as a thread loop guiding portion which guides the needle thread loop (thread loop) guided downside by the first thread guiding portion 24*a* to form a needle thread loop (thread loop) that is larger than a diameter of the chain looper 23 and further guides it to a predetermined position of the spiral-shaped columnar portion 23*b* of the chain looper 23. The first can surface 24*b* is formed to become narrower towards a downward tip thereof. Further, the tip of the first cam surface 24*b* is disposed proximate of a starting position of the spiral shape at which the spiral-shaped columnar portion 23*b* receives the thread loop, namely, proximate of a base 23*c* of the spiral-shaped columnar portion 23*b*. Since the first cam surface 24*b* that functions as a thread loop guiding portion is disposed in this manner, it is possible to reliably wind the needle thread loop (thread loop) to the spiral-shaped columnar portion 23*b*.

The second thread guiding portion 24*c* is a surface that is warped in a substantially arc-like shape that projects upward of the inner hook for chain stitching 24. The second thread guiding portion 24*c* guides the thread upside of the needle thread loop captured by the hook point 21*a* to reliably pass an upper portion of the chain looper 23.

The protruding portion 24*d* is formed to slightly project to the outer peripheral side beyond the accommodating portion 21*b*. The protruding portion 24*d* assists stabilization of a phase at which the hook point 21*a* releases the needle thread loop to be of constant phase.

The second cam surface 24*e* is a cam surface formed close to an outer periphery upward of the inner hook for chain stitching 24 and is disposed at a position on a substantially opposite side of the second thread guiding portion 24*c*. The second cam surface 24*e* guides the needle thread loop that is released by the hook point 21*a* to a predetermined position of the spiral-shaped columnar portion 23*b* of the chain looper 23.

The thread space 24*f* is formed to have a shape in which an outer peripheral portion of the inner hook for chain stitching 24 is partially removed. The thread space 24*f* is provided such that the thread can fall off to upward of the chain looper 23.

With the above configuration, the inner hook for chain stitching 24 restricts upward movement of the needle thread loop that has been drawn into the interior of the outer hook 21.

Here, the inner hook for chain stitching 24 is formed, for instance, by means of a ferromagnetic body such as steel or the like, and its position is maintained by the magnetic force of the magnet 22 so that it does not come off the outer hook 21.

The accommodating portion 21*b* of the outer hook 21*b* is formed such that an inner hook for lock stitching 26 can be mounted instead of the chain looper 23 and the inner hook for chain stitching 24.

Figure 7:
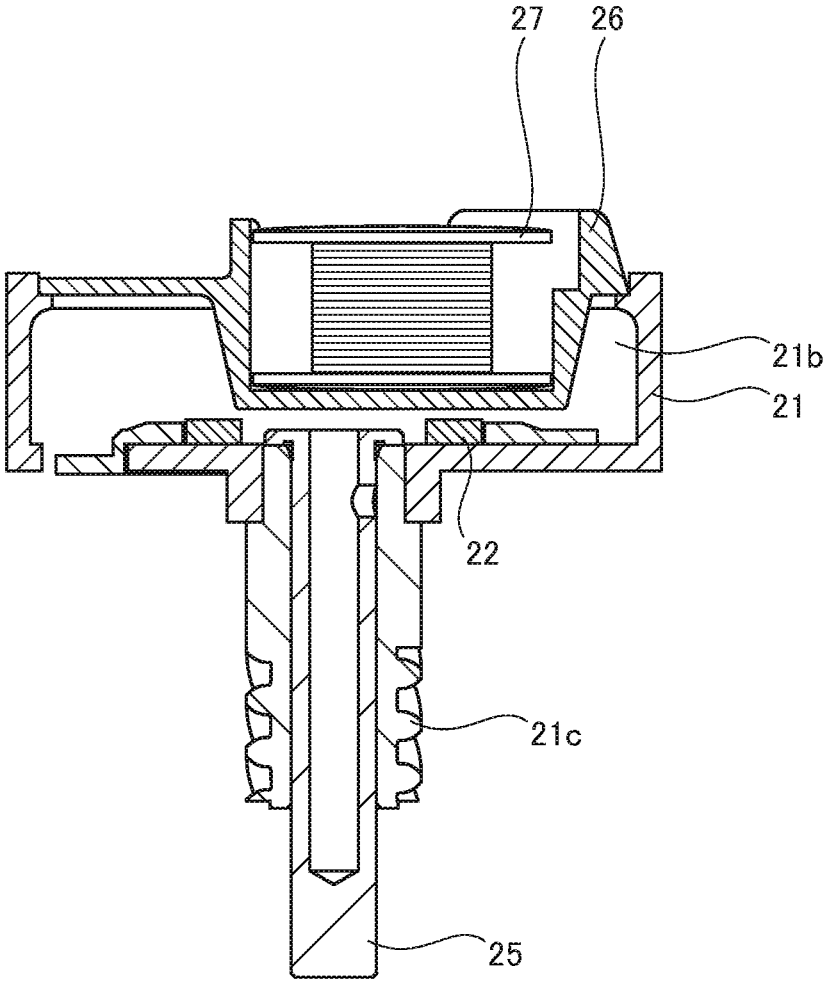
FIG. 7 A sectional view showing a state in which an inner hook for lock stitching 26 is mounted to an accommodating portion 21*b* of an outer hook 21.

FIG. 7 is a sectional view showing a state in which the inner hook for lock stitching 26 is mounted to the accommodating portion 21*b* of the outer hook 21.

It is possible to attach a bobbin 27 reeled with the bottom thread to the inner hook for lock stitching 26, and by assuming this state, the sewing machine 1 according to the present embodiment can perform usual lock stitching.

Next, operations when performing chain stitching using the sewing machine 1 according to the present embodiment will be explained.

First, preparations for chain stitching will be explained.

When the inner hook for lock stitching 26 is disposed in the outer hook 21, the inner hook for lock stitching 26 is taken out from the outer hook 21.

Next, the chain looper 23 is inserted into the accommodating portion 21*b* within the outer hook 21, and the chain looper 23 is integrally attached to the outer hook 21.

Then, the inner hook for chain stitching 24 is mounted onto an upper portion (rib portion) on an outer periphery of the outer hook 21 on an upper portion of the chain looper 23 to fix a throat plate (not shown) to the main body of the sewing machine.

Further, when the needle 10 is not threaded yet, the needle 10 is threaded.

In this manner, preparations for chain stitching are completed.

Next, chain stitching operations will be explained.

Figure 8B:
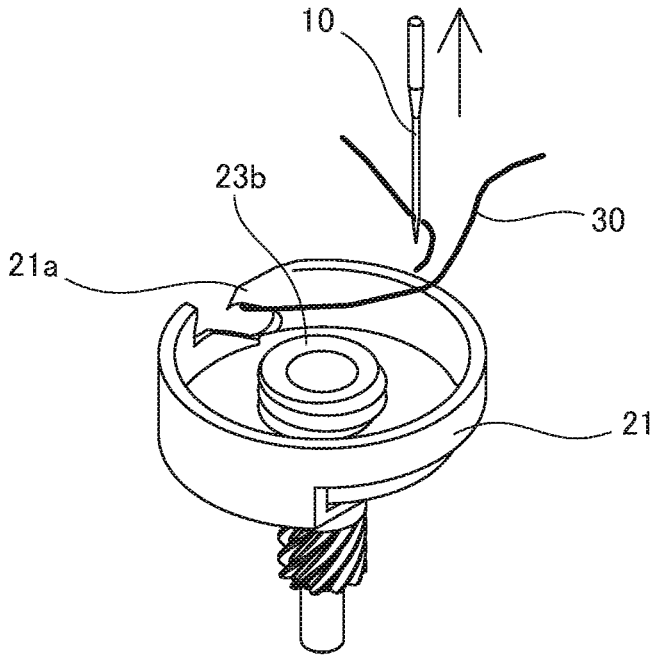
FIG. 8B A view showing a process of performing chain stitching.
Figure 8C:
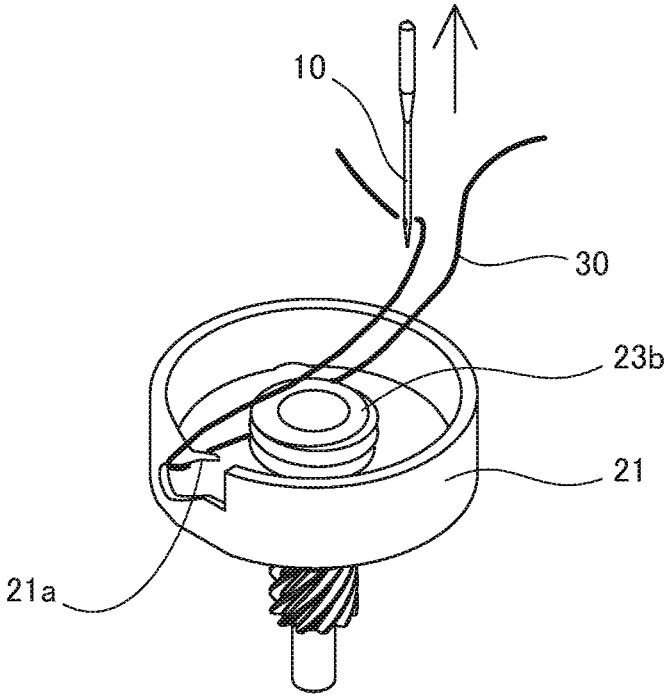
FIG. 8C A view showing a process of performing chain stitching.
Figure 8D:
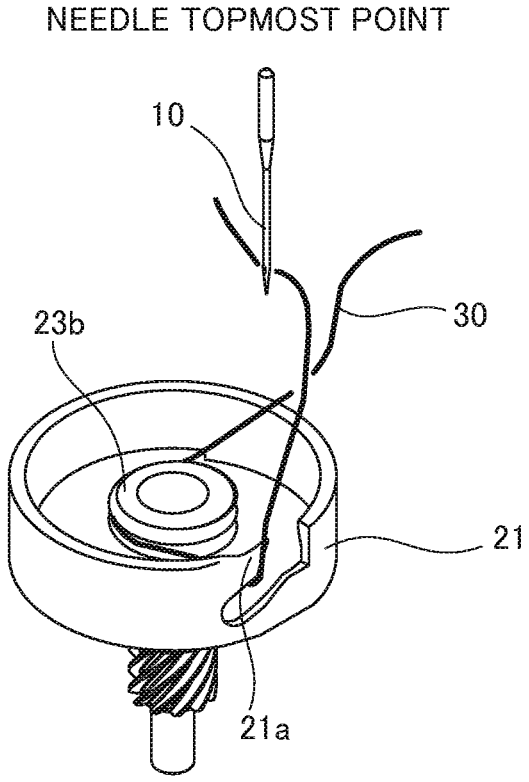
FIG. 8D A view showing a process of performing chain stitching.
Figure 8E:
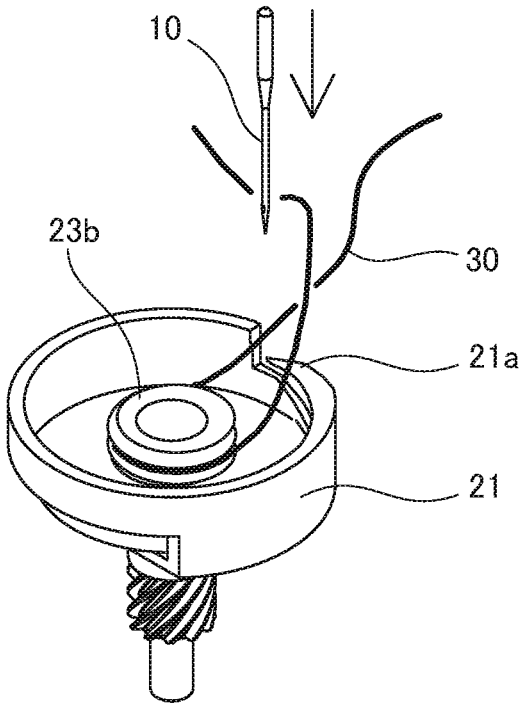
FIG. 8E A view showing a process of performing chain stitching.
Figure 8F:
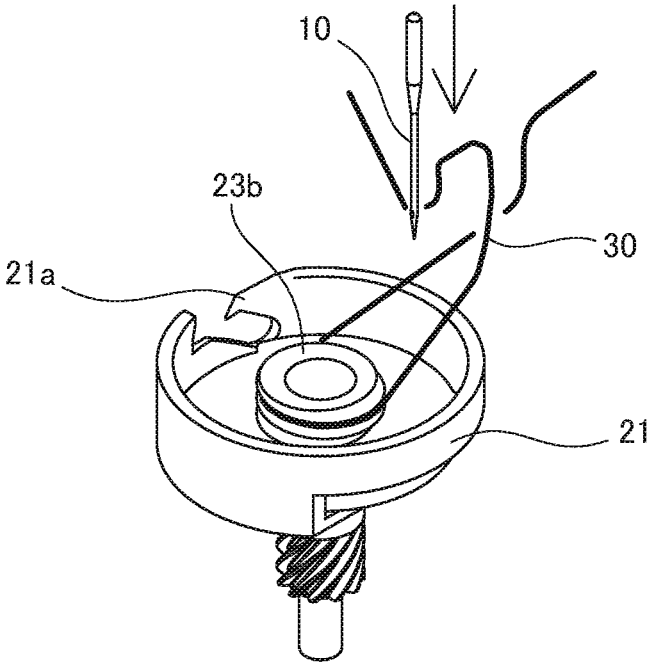
FIG. 8F A view showing a process of performing chain stitching.
Figure 8G:
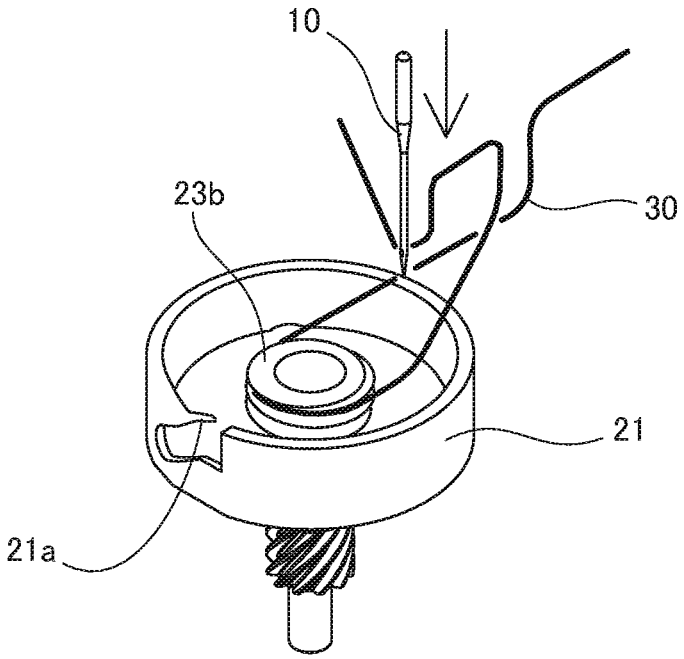
FIG. 8G A view showing a process of performing chain stitching.
Figure 8H:
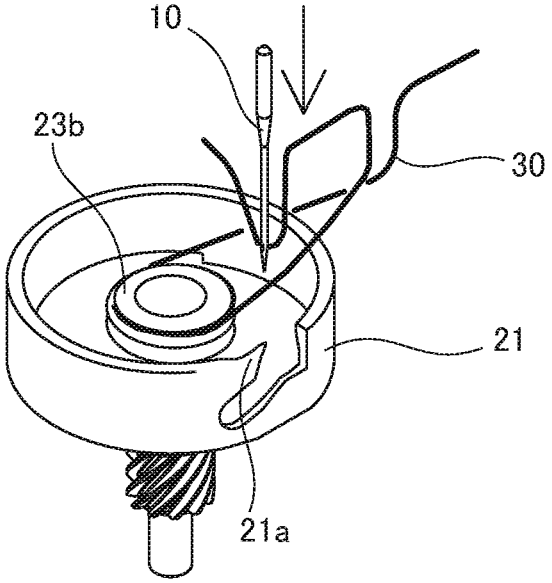
FIG. 8H A view showing a process of performing chain stitching.
Figure 8I:
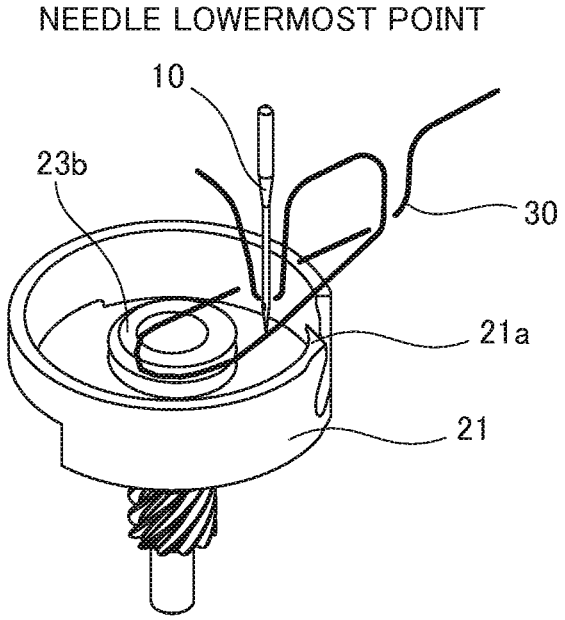
FIG. 8I A view showing a process of performing chain stitching.
Figure 8J:
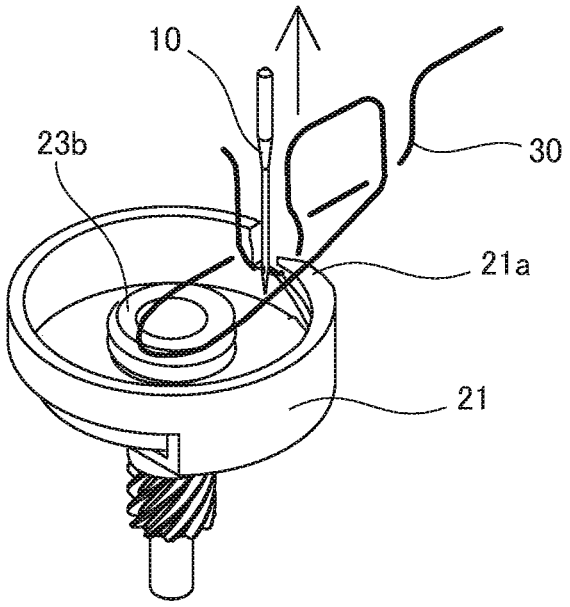
FIG. 8J A view showing a process of performing chain stitching.
Figure 8K:
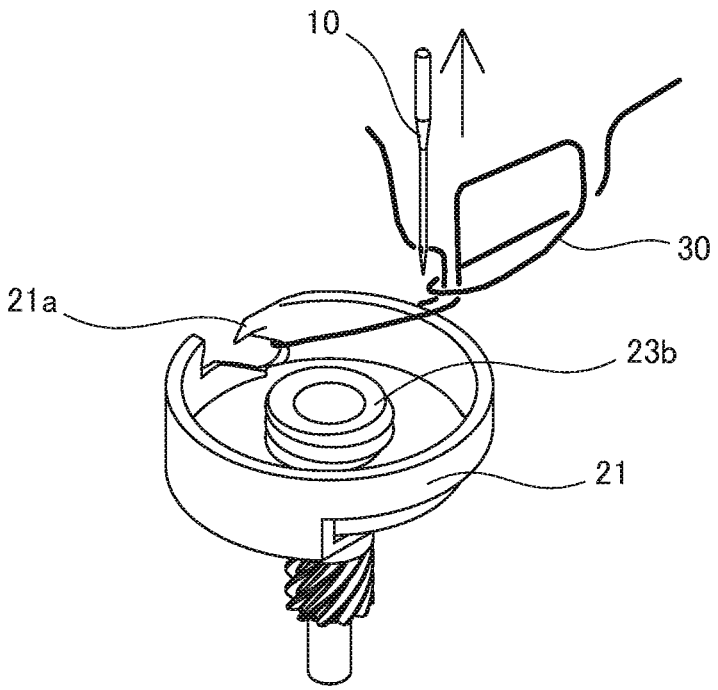
FIG. 8K A view showing a process of performing chain stitching.
Figure 8L:
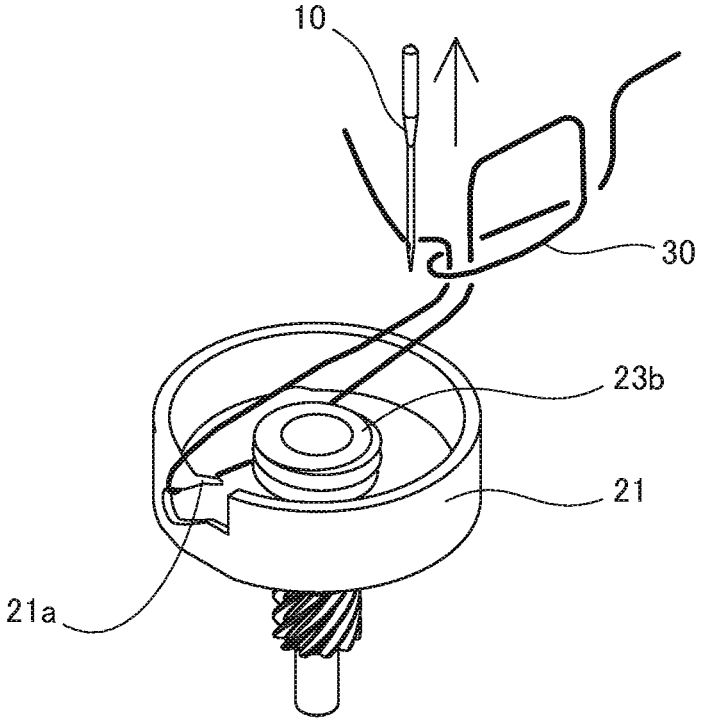
FIG. 8L A view showing a process of performing chain stitching.
Figure 8M:
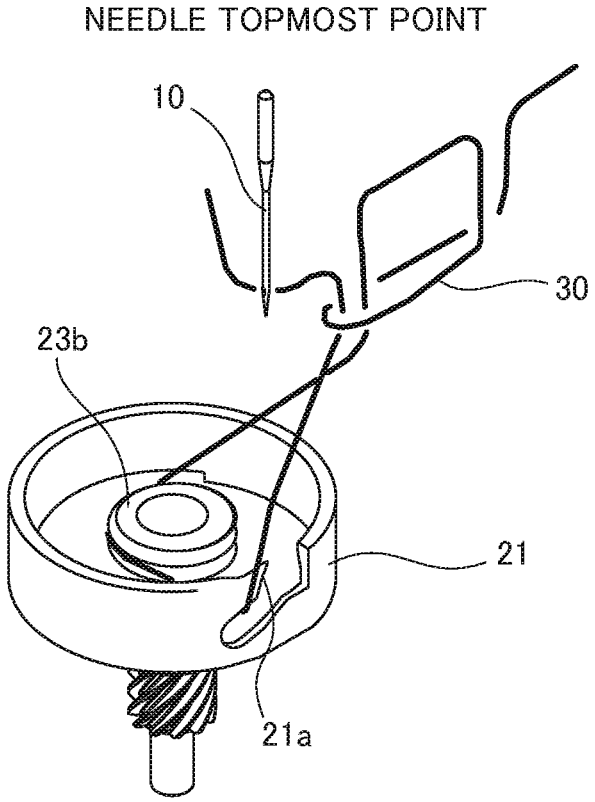
FIG. 8M A view showing a process of performing chain stitching.
Figure 8N:
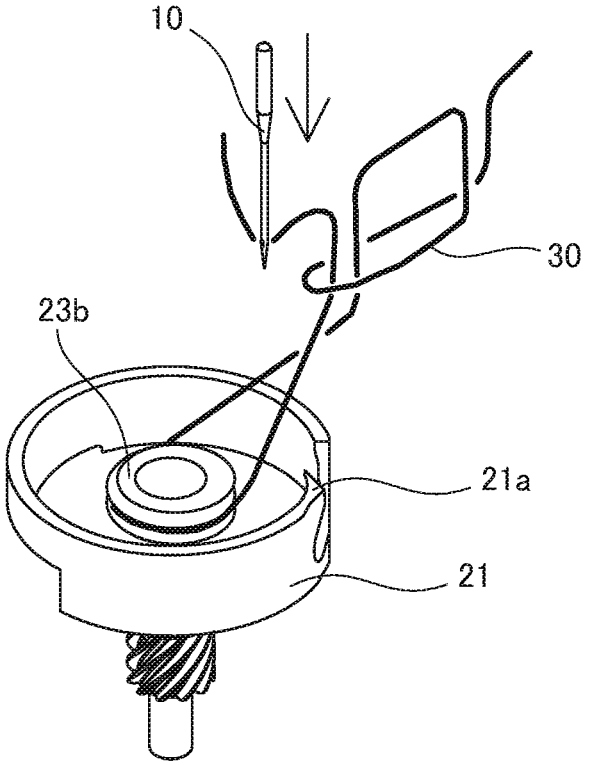
FIG. 8N A view showing a process of performing chain stitching.

FIG. 8A to FIG. 8N are views showing processes of performing chain stitching.

First, a needle thread loop generated below the throat plate through up and down movements of the needle 10 is captured by the outer hook 21 to draw it to downward of the inner hook for chain stitching 24.

More specifically, the hook point 21*a* of the outer hook 21 captures the needle thread by means of the descended needle 10 (FIG. 8A). This process is identical to that for performing lock stitching. A thread positioned inside of the horizontal hook 20 out of the captured needle thread loop is sorted to downside of the hook point 21*a* while a thread positioned outside of the horizontal hook 20 is sorted to upside of the hook point 21*a* and is drawn by the hook point 21*a* (FIG. 8B, FIG. 8C).

Next, the needle thread loop is wound to the spiral-shaped columnar portion 23*b* of the chain loop 23 for holding the needle thread loop. Namely, a thread upside of the needle thread loop that has been drawn by the hook point 21*a* passes the upside of the chain looper 23 while a downside thread is guided by the first cam surface 24*b* of the inner hook for chain stitching 24 and is caught at a downward portion (proximate of the base 23*c*) of the spiral-shaped columnar portion 23*b* of the chain looper 23 (FIG. 8C, FIG. 8D).

Thereafter, when the hook point 21*a* of the outer hook 21 rotates up to a certain phase, the needle thread loop that had been hooked at the hook point 21*a* comes off the hook point 21*a* since the needle thread is pulled down by a take-up lever, and the needle thread loop is wound to a downward portion (proximate of the base 23*c*) of the spiral-shaped columnar portion 23*b* of the chain looper 23 (FIG. 8D, FIG. 8E).

The needle thread loop wound to the spiral-shaped columnar portion 23*b* of the chain looper 23 follows the spiral-shaped columnar portion 23*b* accompanying the rotation of the outer hook 21, namely, the rotation of the chain looper 23 and moves upward of the spiral-shaped columnar portion 23*b* (FIG. 8F, FIG. 8G).

Next, the next descending needle 10 is made to progress into a loop constituted of the held needle thread loop and a cloth fed stitch. More specifically, the repeatedly descended needle 10 passes through the previous stitch and the needle thread loop formed by being caught at the chain looper 23, and the hook point 21*a* of the outer hook 21 captures the needle thread of the descended needle 10. Prior or after the capture, the spiral-shaped columnar portion 23*b* of the chain looper 23 releases the needle thread loop that had been wound thereto (FIG. 8H, FIG. 8I, and FIG. 8J).

Then, the released needle thread loop is tightened by the action of the hook point 21*a* of the outer hook 21 dragging out a needle thread loop of the next stitch and by tightening with the take-up lever which is started at a slightly later phase so as to complete a chain stitch (chain stitch).

More specifically, a needle thread loop that is generated by an ascent of the needle 10 is captured and drawn by the outer hook 21 (FIG. 8K).

At the time of pulling the thread up by means of the take-up lever after capturing of the needle thread, the needle thread loop is guided by the spiral-shaped columnar portion 23*b* of the chain looper 23 to be induced upward (FIG. 8L).

The needle thread loop that has moved upward of the chain looper 23 is pulled upward through a clearance between the chain looper and the inner hook for chain stitching 24 to form a seam (FIG. 8M).

When the needle topmost point has been reached in the state of FIG. 8M, the process returns to the state of FIG. 8E after assuming the state shown in FIG. 8N, and by repeating sewing movements, the sewing machine 1 continues chain stitching.

As explained so far, according to the present embodiment, since the chain looper 23 and the inner hook for chain stitching 24 are provided inside the outer hook 21 in the sewing machine 1, it is possible to realize chain stitching with a simple structure even if the sewing machine is comprised with a horizontal hook.

Further, it is possible to easily switch between lock stitching and chain stitching in the sewing machine 1 by merely exchanging small parts to easily perform chain stitching, and the application range of the sewing machine 1 comprised with a horizontal hook is remarkably improved.

Moreover, since the inner hook for chain stitching 24 is disposed on the upper portion of the chain looper 23 in the sewing machine 1, unmanaged or irregular movements of the needle thread loop captured by the outer hook 21 can be restricted so that chain stitch seams can be reliably formed.

<Modified Embodiment>

The present invention is not limited to the above-described embodiment but may be variously modified and changed which are also included in the scope of the present invention.

For instance, the present embodiment has been explained based on a configuration in which the magnet 22 is fixed to the outer hook 21. The present invention is not limited to this, and it is also possible to provide the magnet at the chain looper 23 or to provide the magnet on the inner hook for chain stitching 24 side.

Further, the present embodiment has been explained based on an example in which the position of the inner hook for chain stitching 24 is held using magnetic force of the magnet 22. The present invention is not limited to this, and it is also possible to hold the inner hook for chain stitching without using magnetic force.

In this respect, while the embodiment and the modified embodiment can be used upon suitably combining them, detailed explanations will be omitted. The present invention is not to be limited by the above explained respective embodiments.

EXPLANATION OF THE REFERENCE NUMBERS

1 sewing machine
10 needle
20 horizontal hook
21 outer hook
21*a* hook point
21*b* accommodating portion
21*c* gear portion
22 magnet
23 chain looper
23*a* disk portion
23*b* spiral-shaped columnar portion
23*c* base of spiral-shaped columnar portion 23*b*
24 inner hook for chain stitching
24*a* first thread guiding portion
24*b* first cam surface
24*c* second thread guiding portion
24*d* protruding portion
24*e* second cam portion
24*f* thread space
25 shaft
26 inner hook for lock stitching
27 bobbin
30 needle thread

What is claimed is:

1. A sewing machine comprising:

a driving structure that reciprocates a needle; and a horizontal hook that rotates twice around a vertical axis of rotation when the needle performs a single reciprocating movement, wherein the vertical axis of rotation of the horizontal hook is parallel to a reciprocating direction of the needle, and perpendicular to a horizontal set up surface of the sewing machine; and wherein the horizontal hook comprises an outer hook including a hook point that captures a thread loop of a needle thread and an accommodating portion that is formed to open upwardly, a chain looper that is held within the accommodating portion of the outer hook to be attachable/detachable to and from the outer hook and to move integrally with the outer hook, that includes a spiral-shaped columnar portion to which the thread loop captured by the hook point is wound, and that rotates together with the pulling the thread up and the rotation of the outer hook to guide the thread loop induced in spiral shape upward, and an inner hook for chain stitching that is supported by the outer hook, that forms a thread space upward of the chain looper and that restricts upward movement of the thread loop drawn into the interior of the outer hook.

2. The sewing machine according to claim 1, wherein the chain looper is held in the accommodating portion of the outer hook at a position concentric with the center of rotation of the outer hook.

3. The sewing machine according to claim 1, wherein the inner hook for chain stitching further guides a thread loop drawn into the interior of the outer hook out of the thread loop that has been captured by the hook point to the chain looper.

4. The sewing machine according to claim 1, wherein the accommodating portion of the outer hook is formed such that the chain looper and the inner hook are detachably attached to the sewing machine.

5. The sewing machine according to claim 1, wherein a thread loop guiding portion for guiding a thread loop is formed on a lower surface of the inner hook for chain stitching.

6. The sewing machine according to claim 5, wherein the thread loop guiding portion is formed to become narrower towards a downward tip thereof.

7. The sewing machine according to claim 5, wherein the tip of the thread loop guiding portion is disposed proximate of a base of the spiral-shaped columnar portion at which the spiral-shaped columnar portion receives the thread loop.

* * * * *